United States Patent [19]

Soares

[11] 3,963,092

[45] June 15, 1976

[54] EXHAUST MUFFLER FOR COMPETITION CAR ENGINES

[76] Inventor: John M. Soares, 2495 American Ave., Hayward, Calif. 94545

[22] Filed: Mar. 5, 1975

[21] Appl. No.: 555,387

[52] U.S. Cl. ..... 181/44; 181/67

[51] Int. Cl.[2] ..... F01N 1/00

[58] Field of Search ..... 181/44, 46, 66, 67

[56] References Cited

UNITED STATES PATENTS

| | | | |
|---|---|---|---|
| 1,157,256 | 10/1915 | Schmitt | 181/67 X |
| 1,236,987 | 8/1917 | Schmitt | 181/44 |
| 1,612,584 | 12/1926 | Hunter et al. | 181/67 X |
| 1,782,396 | 11/1930 | Aaron | 181/67 |
| 1,957,012 | 5/1934 | Haynes | 181/67 X |
| 2,707,525 | 5/1955 | Janeway | 181/67 X |
| 2,911,055 | 11/1959 | McDonald | 181/67 |
| 3,113,635 | 12/1963 | Allen et al. | 181/66 X |
| 3,132,717 | 5/1964 | Baruch | 181/67 X |

FOREIGN PATENTS OR APPLICATIONS

| | | | |
|---|---|---|---|
| 175,118 | 2/1935 | Switzerland | 181/67 |

*Primary Examiner*—John Gonzales
*Attorney, Agent, or Firm*—Lothrop & West

[57] ABSTRACT

An exhaust muffler for competition car engines has a cylindrical, outer or main shell with an inlet at one end smaller than or the same diameter as the main shell and with an outlet at the other end smaller in diameter than the main shell. Inside the main shell is a series of separate, spiral baffles all having the same depth or axial dimension of the spiral and placed equidistantly from each other. The spiral baffles are attached to the interior of the main shell by welds. A round tube open at both ends passes through the center of the spiral baffles beginning at the inlet of the main shell and ending at the outlet of the main shell.

1 Claim, 1 Drawing Figure

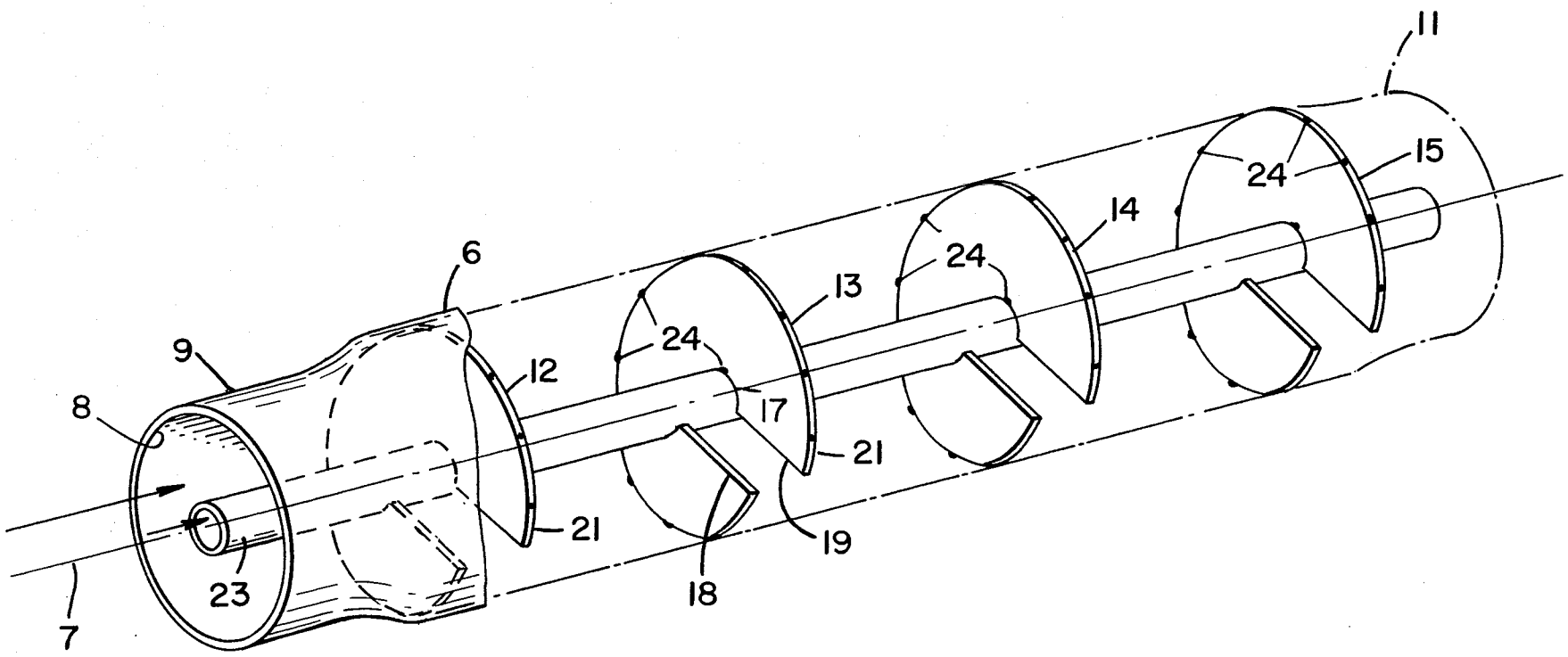
11
15
24
14
24
13
21
19
17
18
24
21
12
6
9
23
8
7

EXHAUST MUFFLER FOR COMPETITION CAR ENGINES

In the exhaust system of competition vehicles such as race cars it is necessary to reduce the noise, particularly high-pitched noise, but without at the same time offering a substantial back pressure or obstruction to the release of the engine exhaust gases. Furthermore, a competition vehicle has usually to operate at substantially maximum output for a protracted period so that heating of the muffler to an unusually high temperature occurs. Some mufflers have been offered utilizing fiberglass mats or similar material as acoustic absorbers, but these, while in many respects effective, have somewhat limited usefulness for that reason and also because they do not always well withstand the relatively high temperature of operation.

It is therefore an object of the invention to provide suitable noise restriction for use in connection with competition vehicle engines, the noise which otherwise would be produced being reduced to an acceptable level.

Another object of the invention is to provide such a muffler in which the back pressure is relatively small and does not impose a substantial obstruction to exhaust gas release and so does not materially reduce or affect the engine horsepower.

Another object of the invention is to provide an acceptable muffler which produces results comparable to that produced by some mufflers with fiberglass or comparable acoustic damping materials but without utilizing such materials and so achieving lesser weight and size.

A particular object of the invention is to reduce substantially the higher pitched and more objectionable noises that otherwise emanate from the competition car exhaust.

Other objects of the invention together with the foregoing are attained in the embodiment of the muffler described in the accmpanying description and illustrated in the accompanying drawing, in which:

The FIGURE is an isometric view of the muffler, portions being broken away to disclose the interior.

This application is related to my abandoned application entitled "Spiral Baffle Engine Exhaust Muffler For Competition Automobiles" Ser. No. 436,207 having a filing date of Apr. 29, 1974.

While a muffler pursuant to the invention can be embodied in a large number of different ways, it has with considerable commercial success been embodied in the form shown in the drawing. In this arrangement there is provided an outer main shell 6 of generally circular-cylindrical form disposed along a longitudinal axis 7. The outer shell is preferably of metal of relatively stiff gauge so that the shell when completed is entirely self-supporting, is a good heat radiator and is long lasting.

At one end 8, designated the inlet, the shell 6 is reduced somewhat in diameter to provide an inlet coupling 9. The diameter of the coupling 9 is preferably no greater than the diameter of the main shell 6 and, as shown, is slightly less in diameter so that the coupling 9 can readily be introduced into or onto the exhaust pipe of a competition engine. The coupling or connection 9 swells gradually to the diameter of the main shell 6.

In a comparable way the main shell 6 at its opposite end is provided with an outlet 11 which again has a diameter related to that of the main shell, but in this instance the diameter of the outlet 11 is preferably substantially smaller than the diameter of the main shell, although there is a smooth merger therebetween.

Located or disposed within the main shell 6 is a plurality of individual spiral baffles 12, 13, 14, 15 and the like. These baffles are conveniently of almost identical configuration and themselves are preferably fabricated of appropriate metal. Each spiral or helical baffle is made of a plate which is pierced to provide a central opening 17 and is cut to provide radial edges 18 and 19. The plate is deformed so that the edges 18 and 19, which extend from the edge of the opening 17 to the outer rim 21 of the baffle, are substantially straight and are spaced apart axially a predetermined amount, all of the baffles being substantially the same.

The individual baffles are situated within the outer shell preferably quite separate and distinct from each other and are spaced substantially apart in an axial direction. The baffles are arranged so that the helical configuration of the baffles is in the same general sense or hand or direction. In effect, the baffles constitute interrupted portions of the same helix, and the edges 18 and 19 extend substantially in the same direction or occupy the same plane. For assembly it is customary to mount the baffles within the outer shell and then separately to reduce one of the ends 9 and 11 or to weld that end on later.

In addition to the baffles, there is provided within the outer shell and extending along the axis 7 thereof a hollow tube 23 having an outer diameter substantially the same as the diameter of the opening 17. The tube 23 is about as long as the outer shell, so that the tube extends from the inlet 8 through all of the interior baffles and to the outlet 11. The inner tube 23 may or may not be secured to the individual baffles by welding or the like. Sometimes a simple press fit is sufficient since the tube 23 substantially occupies all of the openings 17 in each of the baffles. The baffles themselves, however, are secured to the outer shell 6 by individual spot welds 24 or the like. When the job is completed, there results an integral or tightly assembled structure resistant to high temperature distortion.

In the operation of this device, when it is connected to the exhaust pipe of a competition engine, the exhaust gases for the most part enter the inlet coupling 9 and travel around the inside wall of the tube 23. They are given a helical or swirling motion, always in the same direction, throughout the length of the shell and finally exhaust from the outlet 11 to the atmosphere or to a tailpipe, not shown. At the same time some of the exhaust at the inlet coupling 9 travels directly through the inner tube 23 from the inlet to the outlet. The sound frequency of this portion of the exhaust is therefore quite different from the frequency of that portion swirling within the shell.

While changing frequency of some of the gas is important, one of the main functions of the inner tube 23 is to make sure that, despite any resistance to flow in the remainder of the muffler, there is a straight path through the tube 23 from the inlet coupling 9 to the outlet 11. Thus, at no time can the pressure within the inlet of the muffler rise unduly. The amount of exhaust traveling straight through the pipe 23 is relatively small. Induced vibrations in the central pipe and in the outer shell are mutually damped in traveling through the relatively stiff helical discs. The parts are firmly secured together radially and likewise have a substantially fixed axial dimension. Heat distortion is consequently not disruptive.

What is claimed is:

1. An exhaust muffler for competition car engines comprising a circular-cylindrical outer main shell having a predetermined diameter and extending along an axis, said main shell having an inlet at one end of a diameter no larger than said predetermined diameter and having an outlet at the other end of a diameter smaller than said predetermined diameter, a plurality of individual mutually disconnected helical discs forming spiral baffles disposed within said main shell and separated axially from each other, each of said spiral baffles having a pair of axially separated radial edges and having a central opening, means for securing said spiral baffles to said main shell with all of said edges in substantially the same axial plane and with all of said discs extending in substantially the same direction, and a circular-cylindrical tube open at both ends and extending from said inlet through said central openings in each of said spiral baffles in substantial contact with said baffles and to said outlet.

* * * * *